US009578421B2

(12) United States Patent
Pan et al.

(10) Patent No.: US 9,578,421 B2
(45) Date of Patent: Feb. 21, 2017

(54) MINIATURE SPEAKER

(71) Applicants: Song Pan, Shenzhen (CN); Yi Shao, Shenzhen (CN)

(72) Inventors: Song Pan, Shenzhen (CN); Yi Shao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 98 days.

(21) Appl. No.: 14/559,237

(22) Filed: Dec. 3, 2014

(65) Prior Publication Data

US 2015/0341728 A1 Nov. 26, 2015

(30) Foreign Application Priority Data

May 23, 2014 (CN) ..... 2014 2 0270153 U

(51) Int. Cl.

| | |
|---|---|
| ***H04R 1/00*** | (2006.01) |
| ***H04R 9/02*** | (2006.01) |
| ***H04R 9/04*** | (2006.01) |
| *H04R 9/06* | (2006.01) |

(52) U.S. Cl.

CPC ..... *H04R 9/025* (2013.01); *H04R 9/045* (2013.01); *H04R 9/06* (2013.01); *H04R 2499/11* (2013.01)

(58) Field of Classification Search

USPC ..... 381/407, 431

See application file for complete search history.

(56) References Cited

U.S. PATENT DOCUMENTS

| | | | | |
|---|---|---|---|---|
| 7,864,977 | B2 * | 1/2011 | Sadaie | H04R 1/227 381/396 |
| 8,542,864 | B2 * | 9/2013 | Tanabe | H04R 9/043 381/386 |

* cited by examiner

*Primary Examiner* — Amir Etesam

(74) *Attorney, Agent, or Firm* — Na Xu; IPro, PLLC

(57) ABSTRACT

A vibration unit of a miniature speaker is disclosed that the vibration unit has a diaphragm, a voice coil driving the diaphragm along a vibration direction, and a support around which the voice coil is wound. The support includes a base attached to the diaphragm, and a number of sidewalls each extending from a bound of the base along the vibration direction to a distal end thus forming an edge connecting the distal end and the bound. The support further includes a number of smooth corners formed at the edges of the sidewalls. For forming the smooth corners, each of the sidewalls includes two flanges extending from two edges for protecting the voice coil from being cut broken.

10 Claims, 3 Drawing Sheets

MINIATURE SPEAKER

FIELD OF THE INVENTION

The present invention relates to electro-acoustic transducers, more particularly to a miniature speaker used in an electronic device.

DESCRIPTION OF RELATED ART

With the rapid development of wireless communication technologies, mobile phones are widely used. Users require mobile phones to not only have voice function, but also have high quality acoustic performance. A mobile phone also provides the user with entertainment contents, such as music, video, game. For converting electrical signals to audible sounds, a speaker is a necessary component used in a mobile phone for generating sounds. With the mobile phone is designed to be smaller and smaller, the speaker used therein is also required to have a low profile with small size.

Generally, a miniature speaker related to the present disclosure electrically connects to external circuits via elastic contacts which provides electrical signals to the speaker for producing audible sounds. Such a miniature speaker includes a frame, a sound generator accommodated in the frame, and a plurality of contacts positioned by the frame. The sound generator includes a magnetic circuit unit, a diaphragm, and a voice coil driving the diaphragm to vibrate. The voice coil is configured to receive corresponding electrical signals from the external circuit via the elastic contacts by electrically connecting leads wires thereof to the contacts. A typical voice coil used in a miniature speaker includes a support around which conductive wires are wound. The support is generally made of metallic sheet, and the sharp edges thereof may cut the conductive wires broken and further break the circuit formed by the conductive wires, which will badly affect the performance of the miniature speaker.

Accordingly, an improved miniature speaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
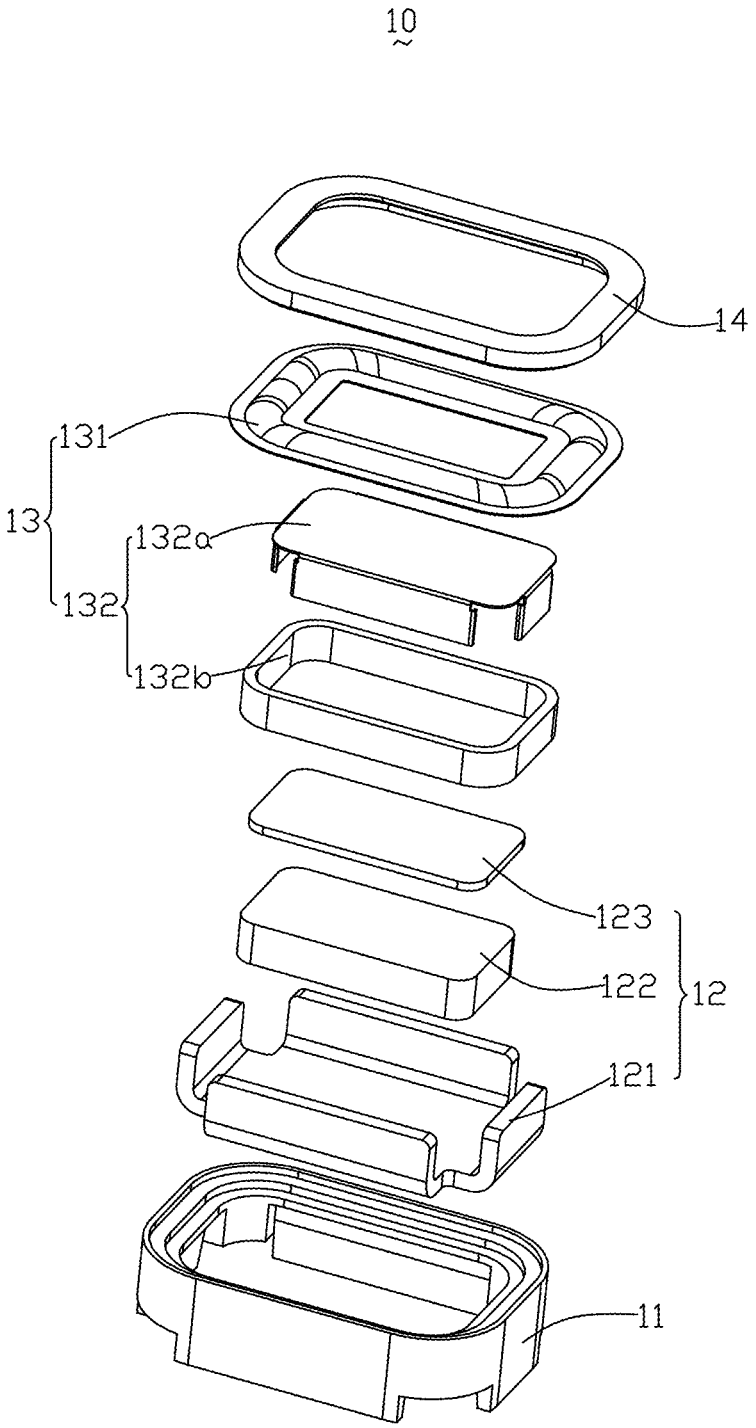
FIG. 1 is an exploded view of a miniature speaker in accordance with an exemplary embodiment of the present disclosure.

Referring to FIG. 1, an exploded view of a miniature speaker 10 in accordance with an exemplary embodiment of the present disclosure, the miniature speaker 10 includes a frame 11 forming a receiving space, a magnetic circuit unit 12 positioned by the frame 11, a vibration unit 13 arranged above the magnetic circuit unit 12, and a cover 14 forming a housing cooperatively with the frame 11. The frame 11 is generally made of plastic, or plastic with conductive members embedded in the plastic, or made of ceramic. The magnetic circuit unit 12 is at least partially received in the receiving space of the frame 11. The magnetic circuit unit 12 includes a yoke 121 made of magnetic conduction material, a magnet 122 positioned on the yoke 121, and a pole plate 123 attached to a top of the magnet 122. A magnet is an object made from a material that is magnetized and is capable of creating its own persistent magnetic field. The vibration unit 13 includes a diaphragm 131, and a coil assembly 132 coupled to the diaphragm 131. Further, the coil assembly 132 includes a support 132*a* and a voice coil 132*b* wound around the support 132*a*. The support 132*a* is generally made from a metallic sheet, and the voice coil 132*b* is generally made of conductive wires, such as copper wires. When electrified, the voice coil 132*b* interacts with the magnetic field produced by the magnetic circuit unit 12 and is forced to move by Lorenz Force. As the coil assembly 132 is coupled to the diaphragm 131, the diaphragm 131 is accordingly forced to move by the voice coil 132*b*, which produces and radiates audible sounds.

Figure 2:
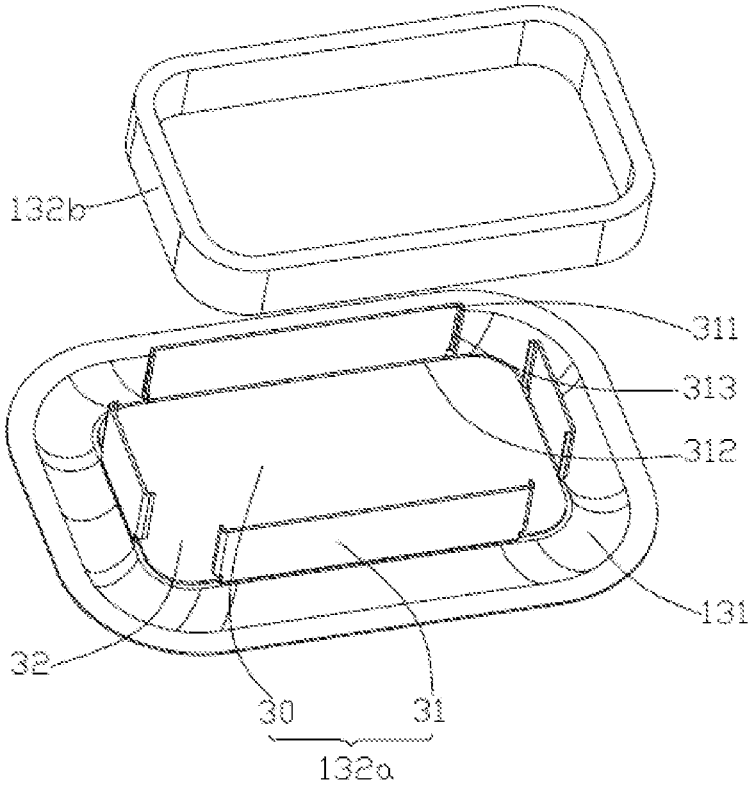
FIG. 2 is an isometric and exploded view of a coil assembly of the miniature speaker in FIG. 1, with a support attached to a diaphragm.
Figure 3:
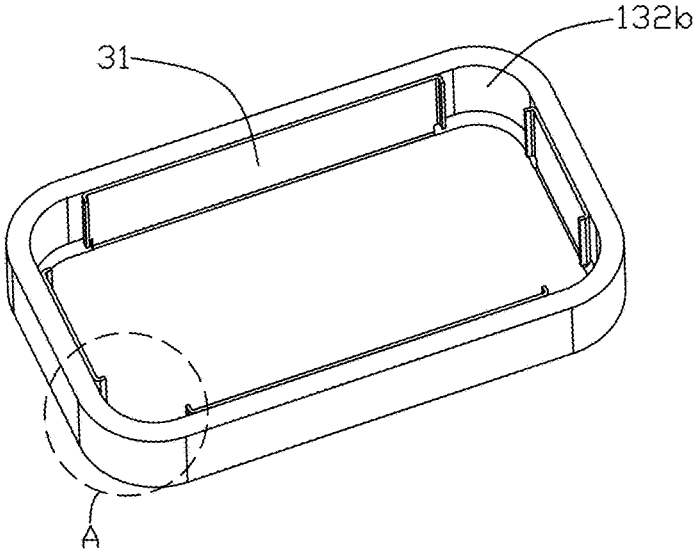
FIG. 3 is an assembled view of the coil assembly in FIG. 2.

Referring to FIGS. 2-3, the support 132*a* comprises a base 30 and a plurality of sidewalls 31 extending perpendicularly from edges of the base 30. It is optional that two adjacent sidewalls form a gap 32 therebetween. The base 32 attaches to the diaphragm 131 by soldering, adhesive, or other ways. The voice coil 132*b* is wound around the sidewalls 31.

Figure 4:
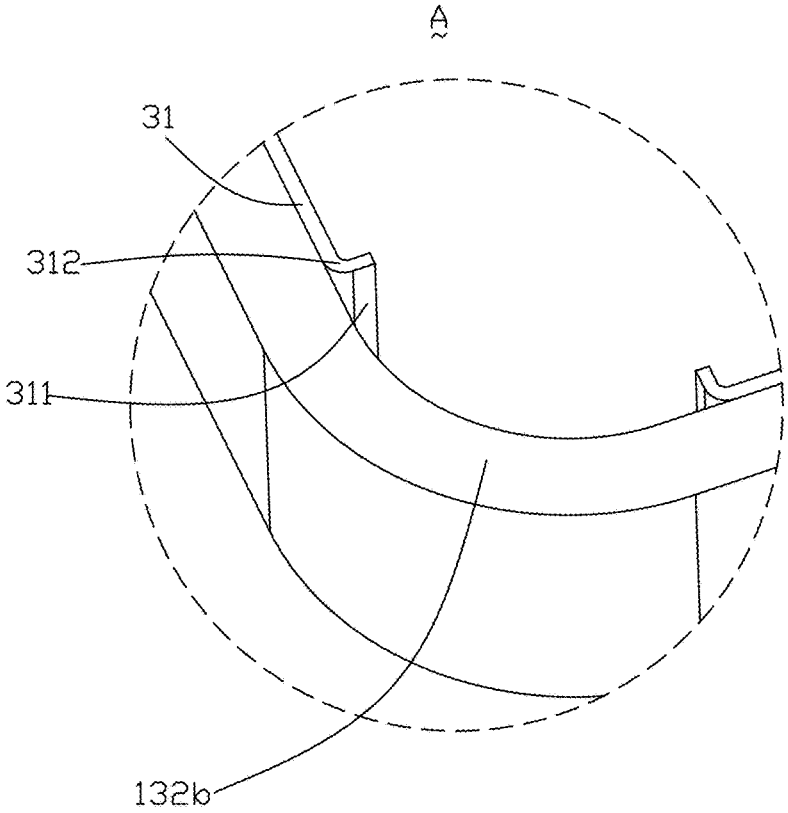
FIG. 4 is an enlarged view of Part A in FIG. 3.

Referring to FIG. 4, an enlarged view of Part A in FIG. 3, each of the sidewalls 31 comprises an upper edge 311 connected with the diaphragm 131, a bottom edge 312 opposited to the upper edge, side edges 313 connecting the upper and bottom edges 311, 312, a pair of flanges 311 extending vertically from two side edges of the sidewall 31 toward a center of a form wound by the voice coil 132*b*. Another word, each of the sidewalls 31 has two opposed smooth corners 312 formed by the flange 311. Further, a line connecting the two corners is parallel to the wound direction of the voice coil 132*b*.

In the present embodiment, the base 30 of the support 132*a* comprises four straight sides and four arc corners connecting two adjacent straight sides. Accordingly, the voice coil 132*b* also comprises four straight sides and four arc corners connecting two adjacent straight sides. The sidewalls 31 are disposed on the four straight sides of the base 30. While coupled to the support 132*a*, the arc corners of the voice coil 132*b* correspond to the gaps 32 between two adjacent sidewalls 31. Also, each of the flanges 311 substantially locates at a joint of the arc corner and an adjacent straight side of the voice coil 132*b*.

By virtue of the flanges, or the rounded corners of the support, the voice coil is protected from being cut broken, especially at the arc corners of the voice coil.

As described in the exemplary embodiment set forth above, a vibration unit of a miniature speaker is disclosed that the vibration unit has a diaphragm, a voice coil driving the diaphragm along a vibration direction, and a support around which the voice coil is wound. The support comprises a base attached to the diaphragm, and a plurality of sidewalls each extending from a bound of the base along the vibration direction to a distal end thus forming an edge connecting the distal end and the bound. The support further comprises a plurality of smooth corners formed at the edges of the sidewalls. For forming the smooth corners, each of the sidewalls comprises two flanges extending from two edges.

It is to be understood, however, that even though numerous characteristics and advantages of the present embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A miniature speaker, comprising:

a frame forming a receiving space;

a magnetic circuit unit received in the space and positioned by the frame;

a vibration unit interacting with the magnetic circuit unit for generating driving force, the vibration unit comprising:

a diaphragm;

a support attached to the diaphragm, the support having a plurality of sidewalls perpendicular to the diaphragm, each of the sidewall having an upper edge connected with the diaphragm, a bottom edge opposited to the upper edge, side edges connecting the upper and bottom edges, and a plurality of flanges extending from the side edges of the sidewalls for forming smooth corners;

a voice coil wound around the sidewalls of the support for driving the diaphragm to vibrate.

2. The miniature speaker as described in claim 1, wherein the support further comprises a base attached to the diaphragm, and the sidewalls extends from bounds of the base.

3. The miniature speaker as described in claim 1, wherein two adjacent side edges of the sidewalls form a gap therebetween.

4. The miniature speaker as described in claim 2, wherein the base comprises a plurality of straight sides and a plurality of arc corners connecting two adjacent straight sides, and the flange locates substantially at the joint of the straight side and an adjacent arc corner.

5. The miniature speaker as described in claim 4, wherein the voice coil also includes straight sides and arc corners, and each of the corners is substantially arranged corresponding to the gap formed by the two adjacent sidewalls.

6. A miniature speaker, comprising:

a magnetic circuit unit;

a voice coil interacting with the magnetic circuit unit for producing driving force;

a diaphragm driven by the voice coil;

a support attached to the diaphragm, the support including a plurality of sidewalls around which the voice coil is wound, each of the sidewalls including an upper edge connected with the diaphragm, a bottom edge opposited to the upper edge, and side edges connecting the upper and bottom edges, two opposed rounded corners extending from the side edges of the sidewalls.

7. The miniature speaker as described in claim 6, wherein the support further includes a base from which each of the sidewalls extend to a distal end, and a plurality of flanges each connecting the distal end to the base and extending inside a shape formed by the voice coil.

8. The miniature speaker as described in claim 6, wherein two adjacent side edges of the sidewalls form a gap therebetween.

9. The miniature speaker as described in claim 7, wherein the base comprises a plurality of straight sides and a plurality of arc corners connecting two adjacent straight sides, and the flange locates substantially at the joint of the straight side and an adjacent arc corner.

10. The miniature speaker as described in claim 9, wherein the voice coil also includes straight sides and arc corners, and each of the corners is substantially arranged corresponding to the gap formed by the two adjacent sidewalls.

* * * * *